US006646670B2

(12) United States Patent
Toyohara et al.

(10) Patent No.: US 6,646,670 B2
(45) Date of Patent: Nov. 11, 2003

(54) IMAGE FORMING APPARATUS AND MANUFACTURING METHOD THEREOF

(75) Inventors: Yuichiro Toyohara, Fujisawa (JP); Kenichiro Kitajima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/819,767

(22) Filed: Mar. 29, 2001

(65) Prior Publication Data

US 2001/0026311 A1 Oct. 4, 2001

(30) Foreign Application Priority Data

Mar. 31, 2000 (JP) ..... 2000-099297

(51) Int. Cl.[7] ..... B41J 27/00

(52) U.S. Cl. ..... 347/244; 347/258

(58) Field of Search ..... 347/238, 241, 347/244, 240, 256, 258; 359/654; 355/1; 385/120

(56) References Cited

U.S. PATENT DOCUMENTS

| | | | | | |
|---|---|---|---|---|---|
| 4,641,944 | A | * | 2/1987 | Honda et al. | 355/1 |
| 4,838,642 | A | * | 6/1989 | De Jong et al. | 385/120 |
| 5,638,479 | A | * | 6/1997 | Takami et al. | 385/124 |
| 6,141,155 | A | * | 10/2000 | Yamaguchi et al. | 359/652 |
| 6,252,722 | B1 | * | 6/2001 | Kittaka et al. | 359/654 |
| 6,388,698 | B1 | * | 5/2002 | Deguchi et al. | 347/240 |
| 6,483,608 | B1 | * | 11/2002 | Shaklee | 358/1.9 |

* cited by examiner

*Primary Examiner*—Hai Pham
(74) *Attorney, Agent, or Firm*—Fitzpatrick, Cella, Harper & Scinto

(57) ABSTRACT

In case of a full-color image forming apparatus, Modulation Transfer Function (MTF) unevenness at an identical location in the longitudinal axis tends to be intensified. The image forming apparatus of the present invention includes a plurality of light emitting heads having rod lens arrays which focus imaging rays on photosensitive members and have different modulation transfer functions, thereby being capable of providing a high quality image at a low cost while preventing optical density unevenness from being produced in the image.

5 Claims, 5 Drawing Sheets

IMAGE FORMING APPARATUS AND MANUFACTURING METHOD THEREOF

BACKGROUND OF THE INVENTION

1. Field of the Invention

The present invention relates to an image forming apparatus such as a copying machine or a printer and a manufacturing method of the image forming apparatus, and more specifically an image forming apparatus which has a plurality of recording heads and a manufacturing method of the image forming apparatus.

2. Related Background Art

An image forming apparatus such as an LED printer forms a latent image by imaging a light beam emitted from an LED array onto a surface of a photosensitive drum by way of a rod lens array.

FIG. 2 is a schematic diagram showing a photosensitive drum and surroundings of an image forming apparatus using an LED array as an exposing light source.

In FIG. 2, the LED array is disposed in a direction perpendicular to a rotating direction of the photosensitive drum, LED elements of the LED array emit rays in correspondence to image information, rays from the LED elements are imaged onto a surface of the photosensitive drum by way of an imaging optical system disposed before the LED array and an electrostatic latent image is formed two-dimensionally on the surface of the photosensitive drum by rotating the photosensitive drum.

A rod lens array is generally used as an imaging optical system in an image forming apparatus which uses such an LED array and disposed in the image forming apparatus is an LED head which is composed of the LED array integrated with the rod lens array consisting of rod lenses regularly arranged linearly in one or two rows between two plates.

FIG. 3 is a diagram descriptive of the rod lens. When a working distance which is a distance as measured from an end surface of the rod lens to an object or an image surface is denoted by L0 and a length of the rod lens itself is denoted by Z0, a conjugate length Tc of the rod lens is:

$$Tc=Z0+2\times L0.$$

An image transmitting characteristic of this rod lens is evaluated as a quality of transmitted image, that is, resolution. This characteristic is expressed by a modulation transfer function (MTF). The MTF is an index which indicates a reproduction fidelity degree to an original image of an image which is formed after a rectangular pattern image shown in FIG. 4, for example, passes through the rod lens array. From FIG. 4, the MTF is defined as follows:

$$MTF(w)=(i(w)max-i(w)min)/(i(w)max+i(w)min)\times 100\%$$

wherein i(w)max and i(w)min respectively denote a maximal value and a minimal value of a rectangular wave response at a spatial frequency of w(lp/mm). The MTF which is closer to 100% indicates image reproduction with higher fidelity to an original image. In addition, "lp" in a unit of the spatial frequency w is an abbreviation of a line pair which is a frequency of a total of a white line and a black line.

The MTF may be more or less variable in a longitudinal direction of the rod lens array. The variation of the MTF makes an uneven electrostatic latent image (hereinafter referred to MTF unevenness) formed on the photosensitive drum even when rays having a uniform quantity are emitted from all the LEDs in the longitudinal direction or allows optical density unevenness to appear on an image and to be formed on a recording material in a worse case. Manufacturers of image forming apparatuses have made various contrivances to prevent the variation of MTF unevenness from appearing in images, thereby making it possible to provide uniform images which are not problematic in practical use.

Furthermore, the rod lens array is manufactured through processes which are described below:

1. Long rod lenses are manufactured in a large quantity.
2. The manufactured long rod lenses are arranged so as to form a sheet.
3. The sheet of the rod lenses is cut out in a length specified so as to obtain a desired TC length.

Owing to the manufacturing processes described above, rod lens arrays which are manufactured from an identical sheet can have MTF characteristics which are nearly equal to one another. Rod lens arrays which are cut out of portions vertically adjacent to each other in particular have a higher tendency to have the MTF characteristic equal to each other.

By composing an LED head of such an LED array and such a rod lens array and using the LED head as an exposing light source, it is possible to dispose the exposing light source in the vicinity of a photosensitive drum and compose an image forming apparatus more compact than a system which uses a semiconductor laser as an exposing light source.

In the case of an image forming apparatus which forms a full-color image generally consisting of four colors of cyan, magenta, yellow and black, MTF unevenness at an identical location in the longitudinal direction tends to be intensified by overlapping and finally appears as remarkable optical density unevenness even when the MTF unevenness appears as slight optical density which is scarcely remarkable on a monochromatic image.

When red is output from an exposing apparatus which produces optical density unevenness of 0.01 in yellow and magenta, for example, the unevenness is overlapped and appears as optical density unevenness on an image. The above-described unevenness in a skin color of a man's face may look like a wrinkle which appears unattractive and does not truly express the intended image.

From a viewpoint of the manufacturing processes, on the other hand, it is pretty difficult to correct more strictly MTF unevenness of the rod lens array and the manufacturing cost inevitably increases when only satisfactory rod lens arrays are selected.

SUMMARY OF THE INVENTION

The present invention has been achieved in view of the above-described problems and has an object to provide an image forming apparatus and a manufacturing method of the image forming apparatus which are capable of suppressing optical density unevenness in an image.

Another object of the present invention is to provide an image forming apparatus and a manufacturing method of the image forming apparatus which are capable of making an optical density of image uniform in a direction perpendicular to a recording material conveying direction.

Still another object of the present invention is to provide an image forming apparatus comprising:

a plurality of light emitting heads, each of said heads having a rod lens array for focusing an image light on a photosensitive member, wherein characteristics of modulation transfer function of each of the above-described rod lens arrays are different from each other.

Still another object of the present invention is to provide a manufacturing method of an image forming apparatus comprising steps of:

clustering a plurality of long rod lenses;

cutting a clustered long rod lens group into a plurality of short rod lens groups; and disposing the short rod lens groups in different image forming apparatuses so that the plurality of short lens groups adjacent to each other in a direction of an optical axis are not disposed in an identical image forming apparatus.

Still another object of the present invention is to provide a manufacturing method of an image forming apparatus comprising steps of:

clustering a plurality of long rod lenses;

cutting a plurality of clustered long rod lens groups into a plurality of short rod lens groups respectively; and disposing the short rod lens groups in different image forming apparatuses so that a plurality of short rod lens groups obtained from a long rod lens group are not disposed in an identical image forming apparatus.

Further objects of the present invention will be apparent from the following detailed description made with reference to the accompanying drawings.

DETAILED DESCRIPTION OF THE PREFERRED EMBODIMENTS

[First Embodiment]

Figure 1:
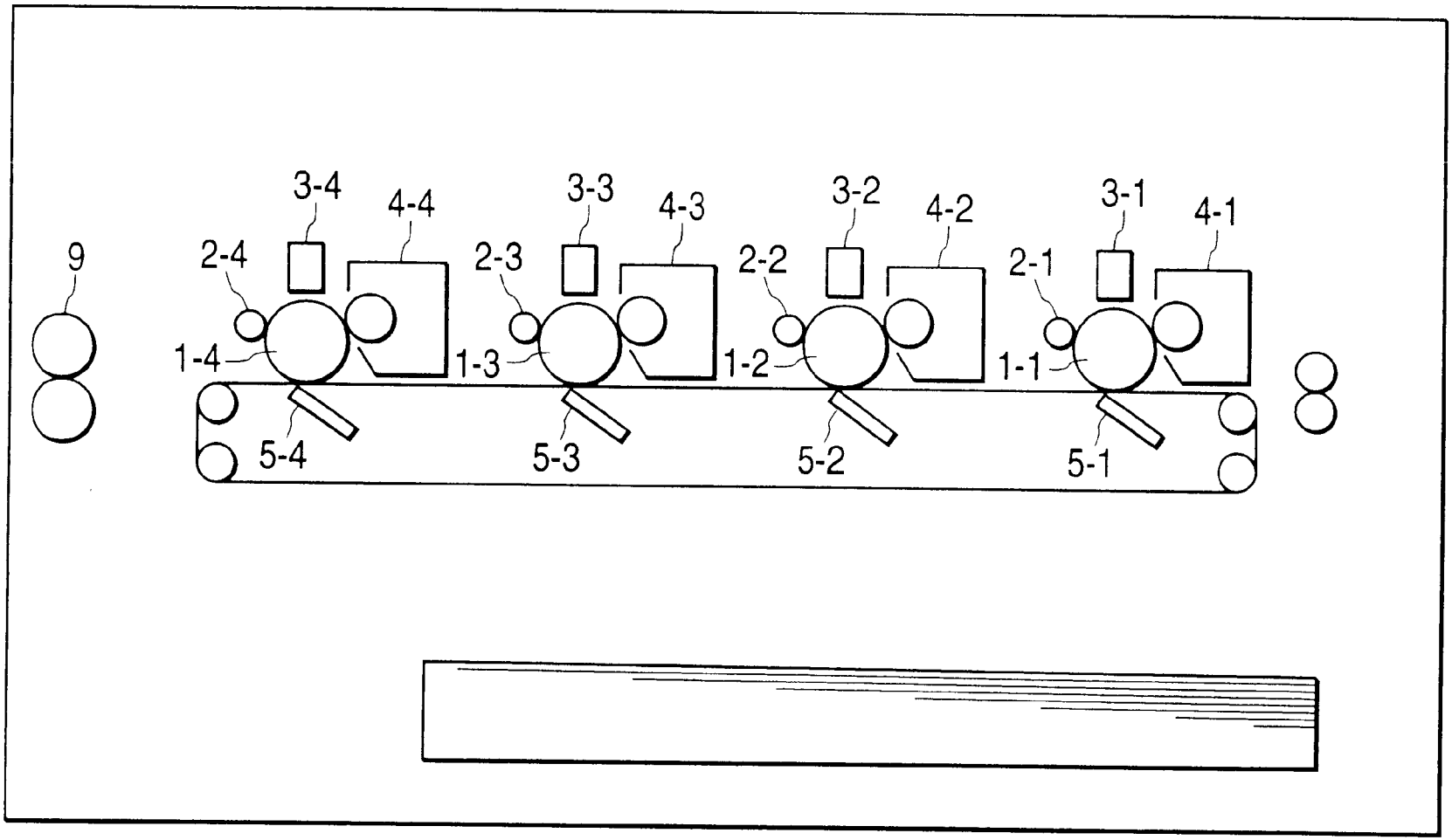
FIG. 1 is a schematic diagram of a main body of an image forming apparatus according to an embodiment of the present invention.
Figure 2:
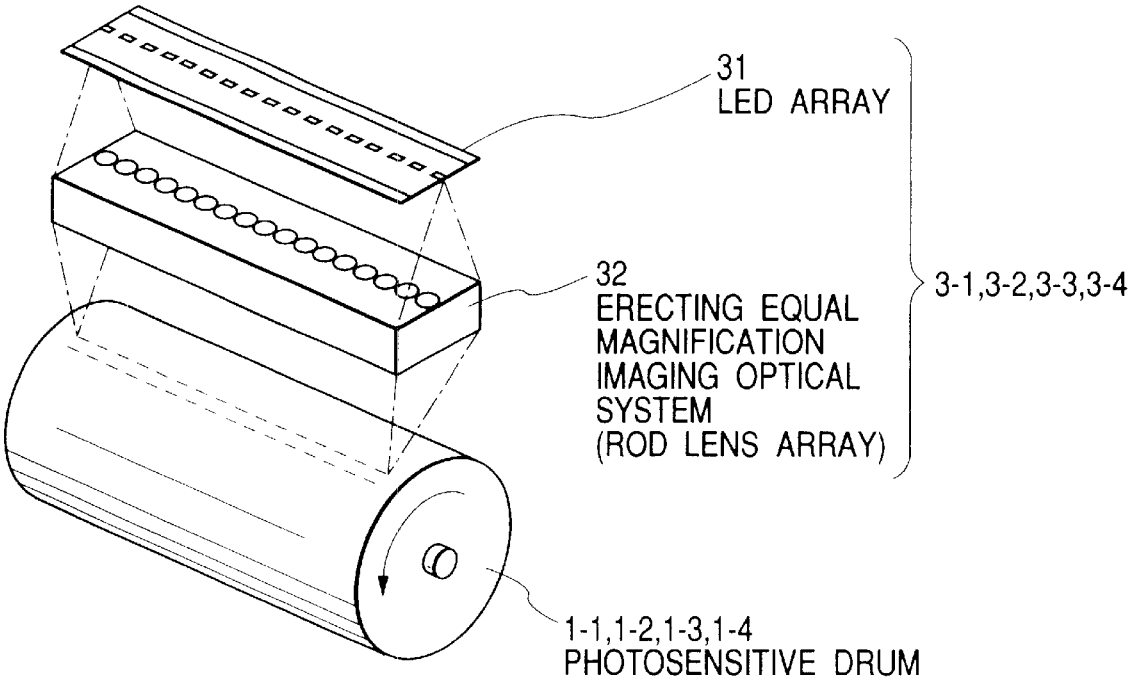
FIG. 2 is a perspective view of main members (a photosensitive drum and an LED head (an LED array and an imaging optical system)) of an image forming apparatus using an LED array according to an embodiment of the present invention.
Figure 3:
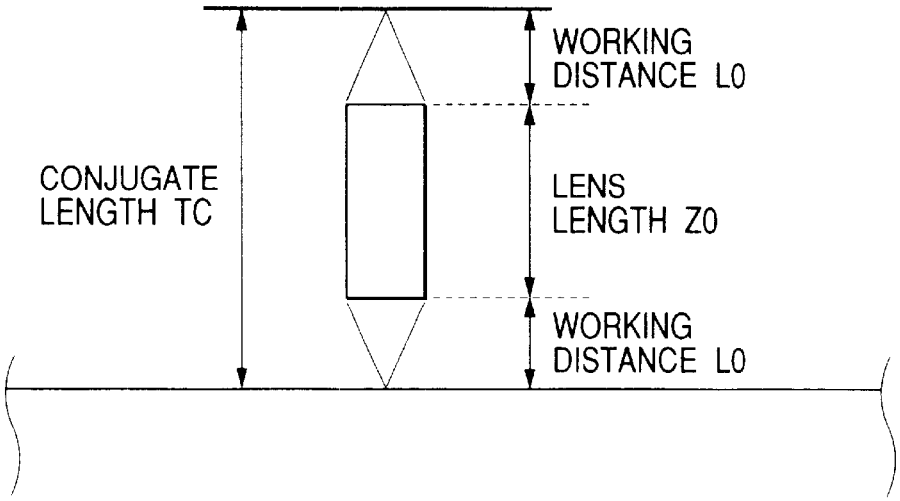
FIG. 3 is a side view showing a side surface of a rod lens, and rays which are incident and emerging on and from the rod lens.
Figure 4:
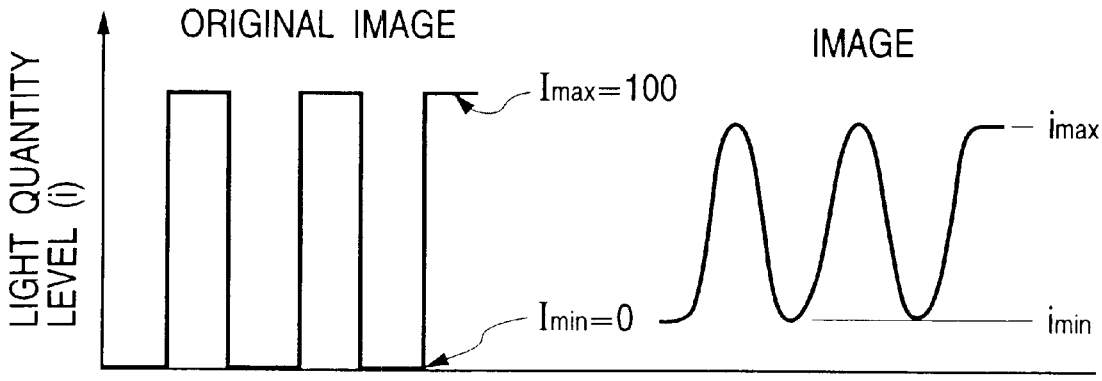
FIG. 4 is a conceptional diagram descriptive of the MTF.

FIG. 1 is a schematic diagram of a main body of an image forming apparatus according to a first embodiment of the present invention. FIG. 2 is a perspective view of main members of an image forming apparatus using an LED array according to an embodiment of the present invention.

In FIG. 2, reference numeral 31 denotes an LED array which functions as an exposing light source and is composed by arranging a plurality of LEDs in parallel with an axial direction of a photosensitive drum 1-1, 1-2, 1-3 or 1-4 disposed as an image bearing body. Reference numeral 32 denotes an erecting equal magnification rod lens array which functions as an imaging optical system and is composed by arranging a plurality of rod lenses arranged linearly in a longitudinal direction of the photosensitive drum 1-1, 1-2, 1-3 or 1-4 so that a light beam emitted from the LED array is imaged on a surface of the photosensitive drum 1-1, 1-2, 1-3 or 1-4 at an equal magnification. In the first embodiment, the LED array 31 is integrated with the rod lens array 32 to compose an LED head 3-1, 3-2, 3-3 or 3-4.

Now, processes to form an image of each color will be described briefly below.

First, a surface of the photosensitive drum 1-1, 1-2, 1-3 or 1-4 is uniformly charged with a primary charger 2-1, 2-2, 2-3 or 2-4 and the photosensitive drum 1-1, 1-2, 1-3 or 1-4 is exposed with the LED head 3-1, 3-2, 3-3 or 3-4 in correspondence to an input image signal, thereby forming an electrostatic latent image on the photosensitive drum 1-1, 1-2, 1-3 or 1-4. The electrostatic image is visualized with a developing apparatus 4-1, 4-2, 4-3 or 4-4 and transferred to a transferring sheet by transferring means 5-1, 5-2, 5-3 or 5-4. Finally, a toner image transferred to the transferring sheet is fixed by fixing means 9.

A reproduction gradation number per pixel is binary.

The first embodiment realizes high-speed image formation by performing the above described image formation processes substantially at the same time for four colors.

A first station which is composed of the photosensitive drum 1-1, the primary charger 2-1, the LED head 3-1, the developing apparatus 4-1 and the transferring means 5-1 forms a yellow image, a second station which is composed of the photosensitive drum 1-2, the primary charger 2-2, the LED head 3-2, the developing apparatus 4-2 and the transferring means 5-2 forms a magenta image, a third station which is composed of the photosensitive drum 1-3, the primary charger 2-3, the LED head 3-3, the developing apparatus 4-3 and the transferring means 5-3 forms a cyan image, and a fourth station which is composed of the photosensitive drum 1-4, the primary charger 2-4, the LED head 3-4, the developing apparatus 4-4 and the transferring means 5-4 forms a black image.

The LED head used in the first embodiment will be described in detail.

First, the LED array 31 has an element density of 600 dpi and an element arrangement period of 42.3 $\mu$m. Furthermore, a light emitting portion of the LED has an electrode size of approximately 20 $\mu$m. This electrode is used as an exposing light source and rays emitted from the exposing light source are imaged on the surface of the photosensitive drum.

Figure 5:
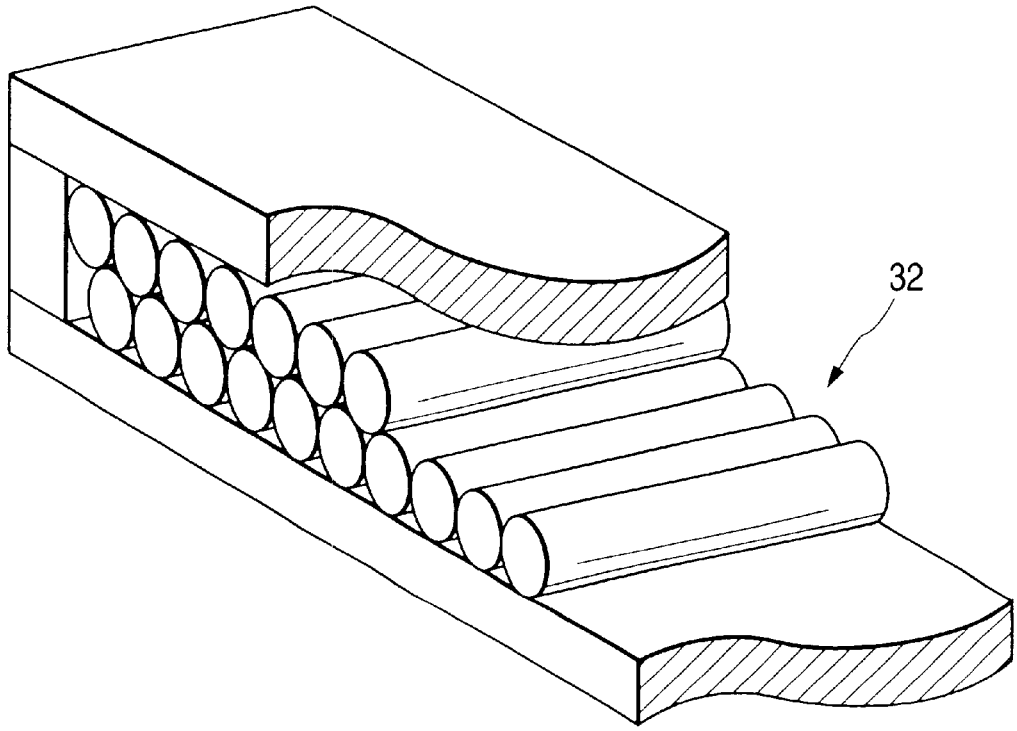
FIG. 5 is a perspective view showing a configuration of a rod lens array according to the present invention.

Description will now be made of the rod lens array 32 which functions as the imaging optical system. The rod lens array is an erecting equal magnification imaging optical system. A rod lens has a diameter of 0.6 mm in the first embodiment. Rod lenses are arranged in two rows as shown in FIG. 5.

A conjugate length of this rod lens array is 9.9 mm.

A manufacturing method of the rod lens array will be described briefly.

First, long rod lenses which have a refractive index varying in a diametrical direction are manufactured in a large quantity. Then, the rod lenses are clustered by arranging themselves in two rows in the longitudinal direction so as to have a width on the order of 310 mm in a lateral direction, and shaped into an array as shown in FIG. 5. Then, the array is finished after cutting the rod lenses so as to have the conjugate length Tc of 9.9 mm.

Owing to the manufacturing processes described above, the MTF characteristics of the rod lens arrays 32 which are in a positional relation close to each other in a direction of an optical axis are similar to each other out of a plurality of rod lens arrays short in the direction of the optical axis which are cut out of a single sheet. In other words, the MTF characteristic of a long rod lens changes little by little in the direction of the optical axis for causes such as a diameter and a refractive index distribution of the rod lens as well as an arrangement and a location of a gravitational center of the rod lens. Accordingly, the MTF characteristics of rod lens arrays which are apart from each other in the direction of the optical axis before cutting are rather different from each other.

Accordingly, light emitting profiles of the LED arrays are nearly equal in yellow, magenta, cyan and black when the rod lens arrays are assembled in the LED heads for colors of an image forming apparatus in a cut order after the rod lens arrays are cut. For example, a spot diameter distribution in a longitudinal direction of the LED arrays is as shown in FIG. 6.

Though an LED head which has a completely flat exposure profile produces no optical density unevenness due to exposure, it is actually difficult to manufacture such an LED head and an attempt to use only LED heads which have remarkably excellent MTF characteristics will increase the manufacturing cost. Accordingly, the image forming apparatus according to the first embodiment uses LED heads which have a spot diameter distribution in the longitudinal direction on the order of that shown in FIG. 6.

Figure 6:
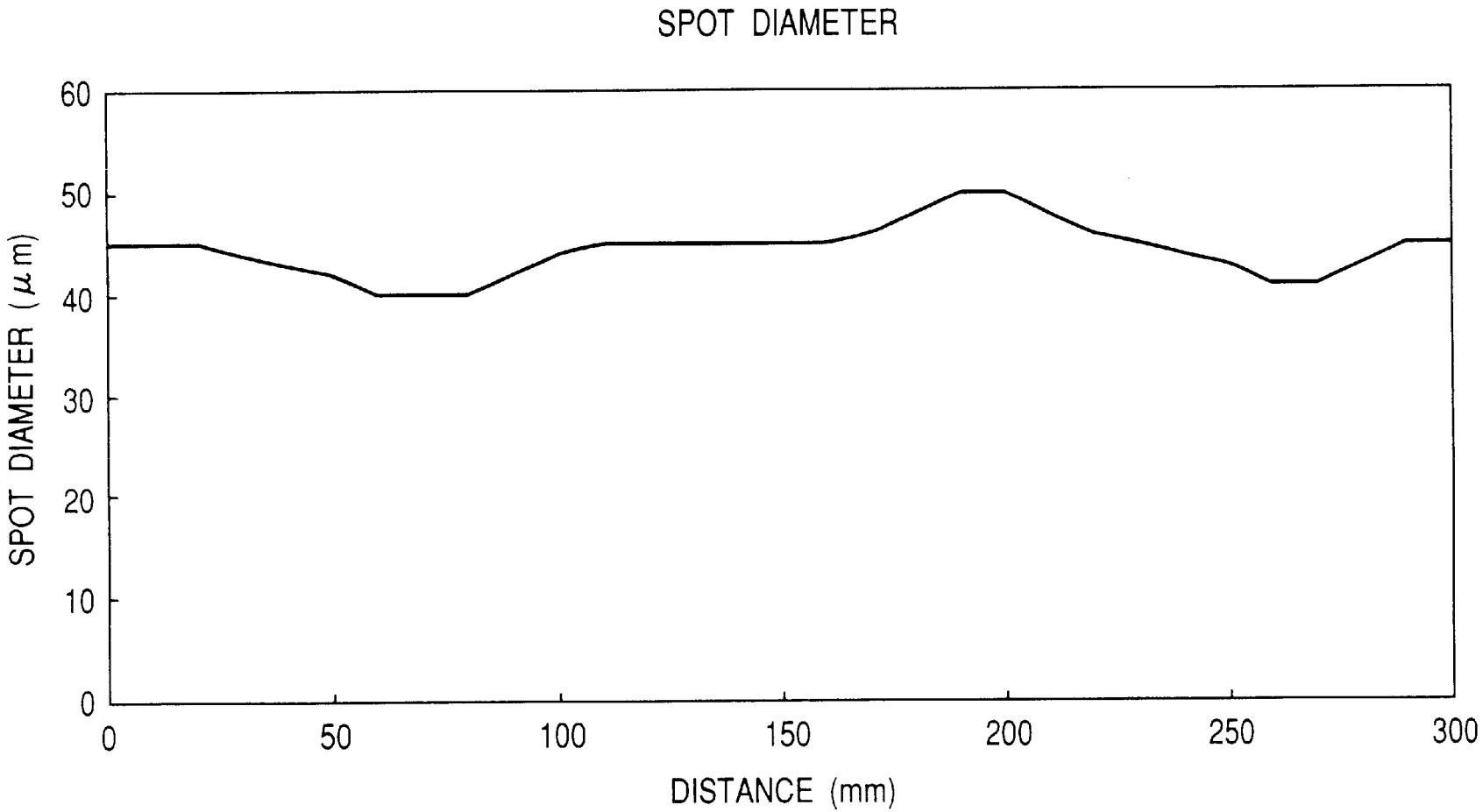
FIG. 6 is a diagram showing a distribution in a longitudinal direction of spot diameters of rays emitted from an LED head according to a first embodiment of the present invention.
Figure 7:
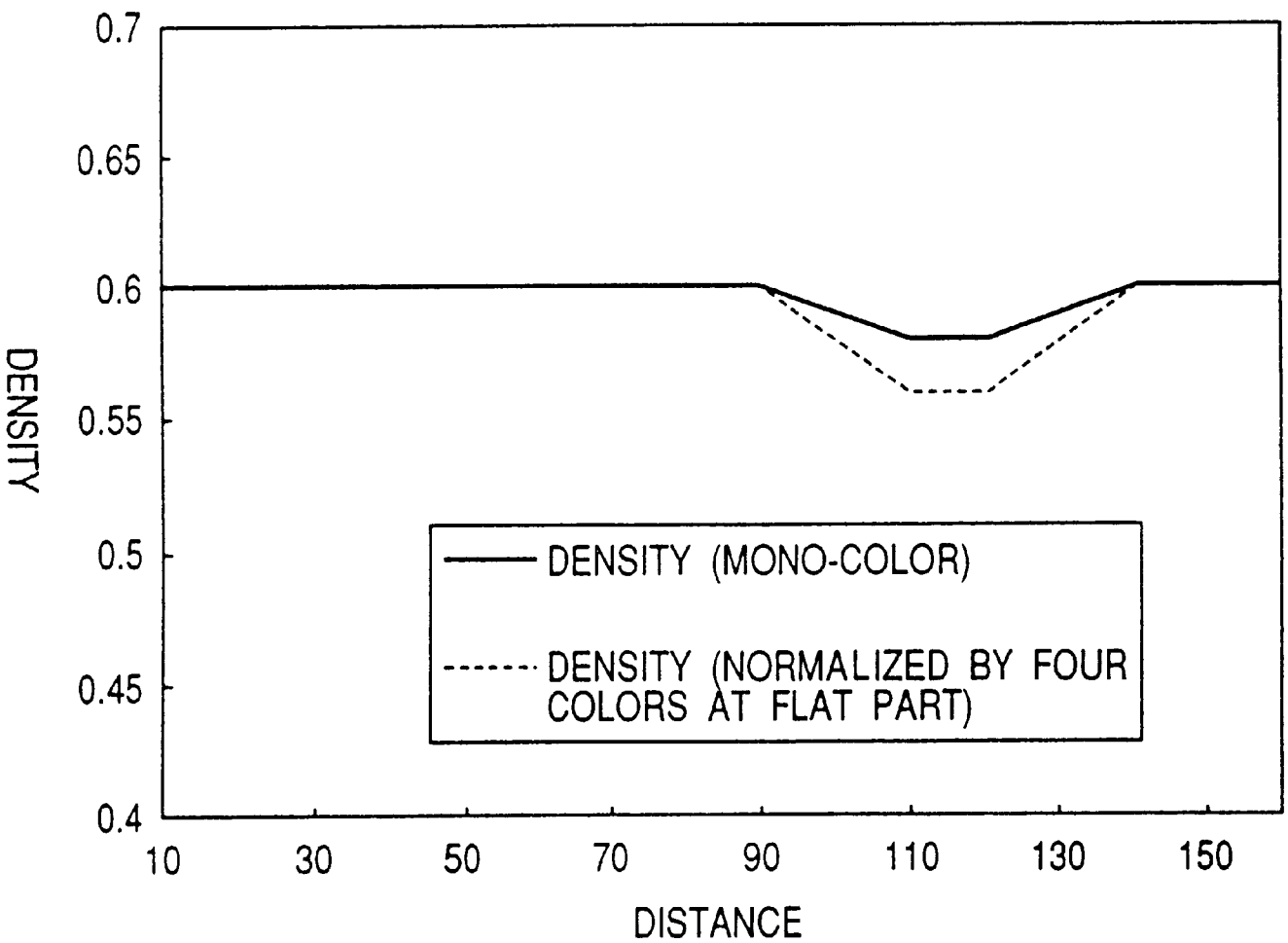
FIG. 7 is a diagram descriptive of optical density unevenness in a conventional example.

When the spot diameter distribution shown in FIG. 6 is obtained in all colors, an optical density difference which is not remarkable in each color is multiplied about four times as high and may be remarkable when the four colors are overlapped. In a case where an image at a halftone density on the order of 0.6 has density unevenness of 0.02 in each color at the same location of the colors in the longitudinal direction as shown in FIG. 7, a density difference on the order of 0.02×4=0.08 is actually produced when four color gray is created by adding the four colors each at a density of 0.6. This description will be sufficient for understanding of an enhancement tendency of density unevenness though the density unevenness is not simply enhanced to 0.08 due to a visual sensitivity characteristic and a color characteristic speaking in detail.

In the first embodiment, the rod lens arrays 32 are numbered and managed in a cut order. The image forming apparatus according to the present invention is configured not to comprise LED heads having successive numbers or at least LED heads having numbers close to one another to prevent density unevenness from being enhanced as described above. Even when rod lens arrays cut out of an identical sheet are used, rod lens arrays which are cut out of locations apart from one another are used in the image forming apparatus since rod lens arrays having successive numbers or rod lens arrays having numbers close to one another are not used in the image forming apparatus. Accordingly, a plurality of LED heads which have different MTF characteristics and different density distributions are used in the image forming apparatus, whereby the LED heads which have the different MTF characteristics and the different density distributions are used for the colors.

Specifically, a certain number of LED heads are reserved for yellow, for example, and then certain numbers of LED heads are reserved for magenta, cyan and black respectively out of LED heads which are manufactured with successive numbers, thereby preventing LED heads having successive numbers from being disposed in the image forming apparatus.

The present invention makes it possible to provide an electrophotography type image forming apparatus which uses as exposing light sources LED heads consisting of LED arrays and rod lens arrays, thereby outputting high quality images at a low cost while preventing optical density unevenness in the images.

[Second Embodiment]

An image forming apparatus according to a second embodiment has a configuration similar to that of the image forming apparatus according to the first embodiment.

The second embodiment is configured not to use rod lenses cut out of an identical rod lens array sheet in the image forming apparatus using a method described below at a step of manufacturing LED heads as exposing devices to be used in the image forming apparatus.

Since rod lens arrays are manufactured by the manufacturing method described in the first embodiment, MTF characteristics of rod lens arrays cut out of an identical rod lens array sheet tend to be relatively close to each other. Out of several factors which determine the MTF characteristics of the rod lens arrays, main factors are diameters of individual rod lenses and deviations of diametrical center positions of the rod lenses arranged in a sheet. Both the factors may be substantially unchanged independently of the rod lens arrays cut out of different locations of the sheet or may be different. It is therefore possible to prevent MTF unevenness from producing density unevenness at the same location in the longitudinal direction and prevent degradation of an image quality, for example, by not-using rod lens arrays cut out of the same sheet in an image forming apparatus.

Description will be made of a manufacturing method of LED heads according to the second embodiment.

First, rod lens arrays to be used are classified into groups of those which are cut out of individual sheets. The group of rod lens arrays obtained from a sheet is assembled in LED heads for a particular color. Accordingly, a color is determined for the LED heads at a stage where the LED heads are manufactured. It is therefore possible to prevent rod lens arrays cut out of an identical sheet from being disposed in an image forming apparatus. Accordingly, a plurality of rod lens arrays cut out of sheets different from one another are used in LED heads for different colors in an image forming apparatus. Accordingly, a plurality of LED heads which have different MTF characteristics and therefore different density distributions are used in an image forming apparatus.

The present invention makes it possible to provide an electrophotography type image forming apparatus which uses as exposing light sources LED heads consisting of LED arrays and rod lens arrays, thereby outputting a high quality image at a low cost while preventing an optical density of image from being uneven.

The present invention is not limited by the above described embodiments and includes modifications which are within an identical technical concept.

What is claimed is:

1. An image forming apparatus comprising:

a plurality of photosensitive bodies;

a plurality of exposing heads respectively provided for each of said plurality of photosensitive bodies, for forming an electrophotographic image by exposing said plurality of photosensitive bodies, each of said plurality of exposing heads having a light emitting diode array for emitting light and a rod lens array formed of a piece of a predetermined length cut from a rod lens array sheet of long rod lenses, for imaging the light emitted from the light emitting diode array onto each of said plurality of photosensitive bodies;

developing means respectively provided for each of said plurality of photosensitive bodies, for developing electrophotographic images on each of said plurality of photosensitive bodies with toner; and transferring means for transferring each toner image on each of said plurality of photosensitive bodies onto a common recording material, wherein the rod lens arrays of said plurality of exposing heads are formed from the pieces of the predetermined length that are not adjacent with each other in an optical axis direction in a condition before cutting from the rod lens array sheet of long rod lenses.

2. An image forming apparatus according to claim 1, wherein the plurality of the rod lens arrays of said plurality of exposing heads are manufactured from different rod lens array sheets.

3. An image forming apparatus according to claim 1, wherein the plurality of the rod lens arrays of said plurality of exposing heads have different MTF characteristics in a longitudinal direction.

4. An image forming apparatus according to claim 1, wherein a color of the toner in said developing means corresponding to one of said plurality of photosensitive bodies is different from a color of the toner in said developing means corresponding to another of said plurality of photosensitive bodies.

5. An image forming apparatus according to claim 4, further comprising fixing means for forming a full color image by fixing the toner images on the common recording material.

* * * * *